United States Patent [19]

Furnari

[11] Patent Number: 4,502,216

[45] Date of Patent: Mar. 5, 1985

[54] SAFETY RAZOR PROVIDED WITH AN ARTICULATED HEAD

[75] Inventor: Giuseppe Furnari, Paderno Dugnano, Italy

[73] Assignee: Tonal S.a.S. di Furnari Giuseppe & C., Italy

[21] Appl. No.: 388,191

[22] Filed: Jun. 14, 1982

[30] Foreign Application Priority Data

Jul. 21, 1981 [IT] Italy ..... 22413/81[U]

[51] Int. Cl.[3] ..... B26B 21/00; B26B 21/14

[52] U.S. Cl. ..... 30/50; 30/58; 30/68; 30/69; 30/85

[58] Field of Search ..... 30/87, 89, 85, 57, 58, 30/47, 50, 68, 69

[56] References Cited

U.S. PATENT DOCUMENTS 4,253,235 3/1981 Jacobson ..... 30/47

4,266,340 5/1981 Bowman ..... 30/47 X

*Primary Examiner*—E. R. Kazenske

*Assistant Examiner*—Willmon Fridie, Jr.

*Attorney, Agent, or Firm*—Darby & Darby

[57] ABSTRACT

A safety razor is provided with a handle at one end of which is rigidly connected a head. A pair of movable, facing hooks is disposed at the ends of the head, and the hooks are removably engageable within housings formed in a blade-holder base. The hooks are pivotally mounted on corresponding pivot pins integral with the head and project along a certain portion from corresponding slots formed in the head. The slots define the stroke of the hooks from a first position of mutual maximum approaching to a second position of maximum spacing. The first position is obtained by way of a spring acting between the hooks. The head is fastened to the razor handle by a screw so that it can be disassembled therefrom, if necessary.

1 Claim, 3 Drawing Figures

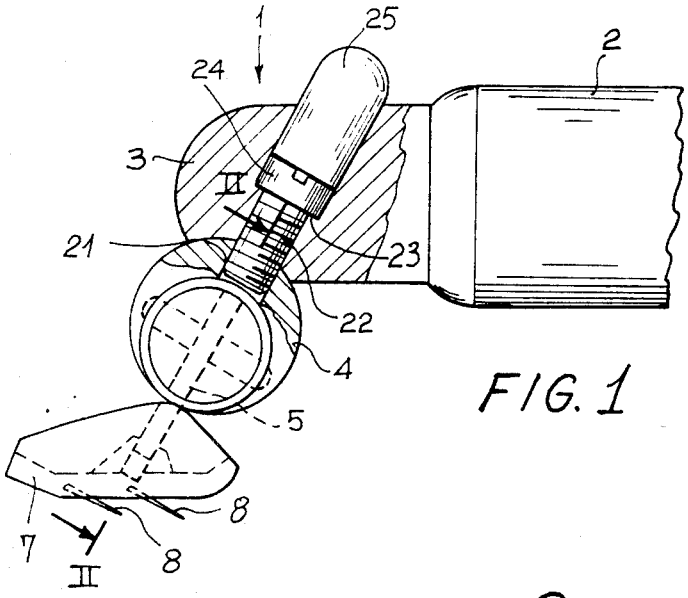
FIG. 1
FIG. 2
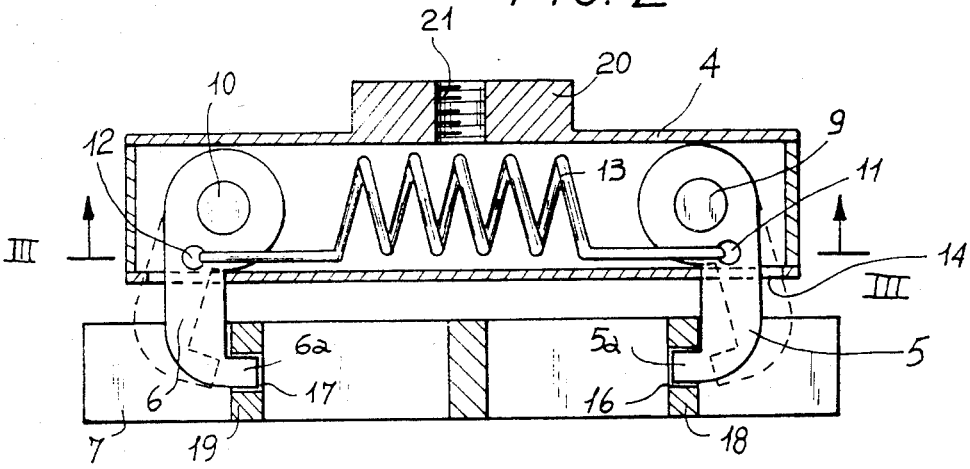
FIG. 3
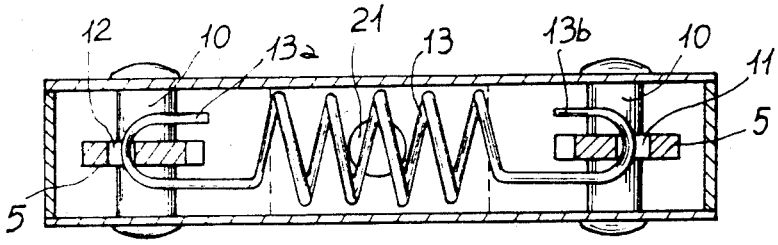

SAFETY RAZOR PROVIDED WITH AN ARTICULATED HEAD

FIELD OF THE INVENTION

The present invention relates to a safety razor provided with an articulated head comprising a handle at one end of which is rigidly connected a head, a pair of movable, facing hooks disposed at the ends of said head and means suitable to allow the removable engagement of said hooks within suitable housings obtained in a blade-holder base. It is known that in safety razors provided with an articulated head, owing to the presence of a pair of hooks disposed at the ends of the head, the blade-holder base is so hooked that it can oscillate along a predetermined angle in order to better fit, during the shaving, the anatomy of the face to be shaved. More particularly, housings are provided in the blade-holder base, which is normally made of plastic material, in which the ends of the hooks are engaged so that they form the rotation pivots of the same base.

BACKGROUND OF THE INVENTION

At the present time the safety razors of this kind, in order to be able to hook to the blade-holder base, are provided with a snap mechanism which, suitably operated by means of a pushbutton placed on the back portion of the head, actuates the maximum opening of the hooks. In these conditions the head is brought near the blade-holder base and is pressed against it till a counter-pushbutton disposed on the face of the head causes the above mechanism to release so that the hooks close and engage with the housings arranged on the blade-holder base. The safety razors provided with an articulated head of the kind described above have some drawbacks, both concerning their operating features and their technical features.

Firstly it is to be noted that in order to obtain the release of the mechanism shutting the hooks on the blade-holder base the head has to be brought near the latter in order to form an appropriate and exact angle, otherwise the blade-holder base cannot be hooked.

Secondly, the release mechanism is very complex as it requires the use of very small parts, also made of plastic material, which are articulated to each other and opposed by the action of very small springs. Owing to this complexity, compared with the sizes of the different members, after a certain period of use of the razor the release mechanism tends to jam. In fact, when a certain quantity of residual soap, mixed with very small beard hair have laid down on the different members of the mechanism, the motions of said members are hampered and the jamming of the mechanism is bound to happen.

In addition, as the head is not detacheable it is not possible to reach the members thereof in order of clean them and therefore, as the mechanism cannot be cleared, the razor becomes out of use.

OBJECT

The main object of the present invention is to perform a safety razor provided with an articulated head which can be easily applied to the blade-holder base and which is so constructed that it is never subject to the jamming of the hinge joints allowing its hooking to the blade-holder base.

SUMMARY OF THE INVENTION

This and other objects which will appear from the description which follows are attained, according to the present invention, by a safety razor provided with an articulated head which is characterized in that said hooks are pivotally mounted on corresponding pivot pins integral to the head and project along a certain portion, from corresponding slots formed in the same head, said slots defining the stroke of said hooks from a first position of maximum approaching to a second position of maximum spacing, said first position being obtained by way of an extension spring acting between said hooks.

Further features and advantages of the present invention will appear more evident from a detailed description of a preferred embodiment of a safety razor provided with an articulated head given hereinafter, by way of example only, with reference to the accompanying drawings.

BRIEF DESCRIPTION OF THE DRAWINGS

FIG. 1 is a part sectional side view of a razor provided with an articulated head;

FIG. 2 is a sectional view of the head along the line II—II of FIG. 1;

FIG. 3 is a sectional view of the head along the line III—III of FIG. 2.

DESCRIPTION OF A PREFERRED EMBODIMENT

Referring to the drawings and particularly to FIG. 1, it is generally indicated at 1 a safety razor provided with an articulated head, comprising a handle 2 one end 3 of which is rigidly connected to a head 4.

The head 4 is provided with a pair of movable, facing hooks 5 and 6 disposed at the ends of the head itself in order to hook a conventional blade-holder base 7 known in itself, carrying one or more blades 8.

According to the present invention the hooks 5 and 6 are pivotally mounted on corresponding pivot pins 9 and 10 rigidly mounted, for example by means of rivets, on the head 4. The hooks 5 and 6 are provided, close to the pivots 9 and 10, with corresponding holes 11 and 12 in which engage the hook-shaped ends 13*a* and 13*b* of an extension spring 13 acting between the hooks 5 and 6. The latter partly project from corresponding slots 14 and 15 formed in the head 4.

The ends of said slots 14 and 15 define the oscillating stroke of hooks 5 and 6 from one position of maximum mutual approaching to a second position of maximum spacing.

At their maximum mutual approaching position the end portions 5*a* and 6*a* of said hooks can engage within suitable housings 16 and 17 arranged in corresponding eyelets 18 and 19 usually provided in the blade-holder base 7.

Always referring to FIG. 2, the head 4 comprises a substantially cylindrical and hollow body which is provided, at its connection to the handle 2, with a projecting portion 20 having a threaded through hole 21. Referring to FIG. 1, in register with said threaded hole 21, a through hole 22 is provided at the end 3 of handle 2, in said hole 22 being defined an annular abutment 23 against which abuts a securing screw 24 screwed into the threaded hole 21 of head 4.

The upper portion of hole 22 is closed by a plug 25 or the like, preferably made of plastic material, which has to be taken away only when the replacement of head 4 is necessary, for example in case of break of same.

The application and operation of the safety razor provided with an articulated head described above is particularly simple and effective. When a blade-holder base 7 has to be hooked to the head 4 of razor 1, it is necessary, holding the blade-holder base in one's hands or, still better, keeping it in the appropriate case supplied by blade producers, to dispose the head 4 so that one of the end portions of hooks 5 and 6, for example portion 5*a*, enters into the corresponding housing 16. In order to carry out this operation it is not necessary for the razor 1 to approach to the blade-holder base 7 according to a particular inclination. After this operation, the head 4 must be pushed leftwards referring to FIG. 2, so that the end portion 6*a* of hook 6 can overcome the obstacle represented by the eyelet 19. Afterwards it is sufficient to lightly press the head 4 towards the blade-holder base 7 in order to obtain that the end portion 6*a* easily engages in the housing 17 of the eyelet 19.

When the head 4 has to be disengaged from the blade-holder base 7, it is necessary to push the head 4 rightwards or leftwards so that the hook opposite to the direction in which the thrust was exerted, can disengage from its housing, thus allowing the head 4 to be moved away from the blade-holder base 7. Then the end portion of the hook still engaged is withdrawn and the head 4 is again clear. The most important advantages of the present invention reside in the fact that the head 4 of razor 1 can easily get engaged or disengaged from the blade-holder base 7 and that, owing to the presence of only one strong spring working by extension, hooks 5 and 6 are never subject to jamming.

In addition, should, for any reason, head 4 break, it can be easily replaced without being obliged to throw away the razor, as it is secured to the handle by means of a screw. Obviously, various structural and operational features disclosed in the foregoing description are susceptible of a number of modifications and changes without departing from the scope and spirit of the present invention, as defined in the appended claims.

What is claimed is:

1. A safety razor provided with an articulated head comprising a handle at one end of which is rigidly connected a head, a pair of movable, facing hooks disposed at the ends of said head and means suitable to allow the removable engagement of said hooks within suitable housings obtained in a blade-holder base, characterized in that said hooks are pivotally mounted on corresponding pivot pins integral to the head and project along a certain portion from corresponding slots formed in the same head, said slots defining the stroke of said hooks from a first position of maximum mutual approaching to a second position of maximum spacing, said first position being obtained by way of an extension spring acting between said hooks, further characterized in that said head comprises a substantially cylindrical and hollow body provided with a projecting portion having a threaded through hole into which is screwed a securing screw housed in a corresponding hole formed in said end of the handle, said hole being closed, above the securing screw, by a plug or the like.

* * * * *